US006114078A

United States Patent [19]

Aylward et al.

[11] Patent Number: 6,114,078

[45] **Date of Patent: *Sep. 5, 2000**

[54] IMAGING ELEMENT WITH BIAXIALLY ORIENTED FACE SIDE WITH NON GLOSSY SURFACE

[75] Inventors: Peter T. Aylward, Hilton; Robert P. Bourdelais, Pittsford; Douglas N. Haydock, Webster; Thaddeus S. Gula, Rochester, all of N.Y.

[73] Assignee: Eastman Kodak Company, Rochester, N.Y.

[ * ] Notice: This patent is subject to a terminal disclaimer.

[21] Appl. No.: 08/998,358

[22] Filed: Dec. 24, 1997

[51] Int. Cl.[7] ..... G03C 1/79; G03C 1/765

[52] U.S. Cl. ..... 430/201; 430/200; 430/496; 430/536; 430/538; 430/950; 156/219; 156/279; 347/106

[58] Field of Search ..... 430/536, 538, 430/950, 523, 201, 200, 496; 156/219, 279; 347/106

[56] References Cited

U.S. PATENT DOCUMENTS

| | | | |
|---|---|---|---|
| 4,179,541 | 12/1979 | Miyama et al. | 430/536 |
| 4,187,113 | 2/1980 | Mathews et al. . | |
| 4,283,486 | 8/1981 | Aono et al. . | |
| 4,377,616 | 3/1983 | Ashcraft et al. . | |
| 4,632,869 | 12/1986 | Park et al. . | |
| 4,758,462 | 7/1988 | Park et al. . | |
| 4,912,333 | 3/1990 | Roberts et al. . | |
| 4,921,781 | 5/1990 | Takamuki et al. | 430/950 |
| 4,994,312 | 2/1991 | Maier et al. . | |
| 5,429,916 | 7/1995 | Ohshima . | |
| 5,466,519 | 11/1995 | Shirakura et al. . | |
| 5,476,708 | 12/1995 | Reed et al. . | |
| 5,514,460 | 5/1996 | Surman et al. . | |
| 5,516,563 | 5/1996 | Schumann et al. . | |

FOREIGN PATENT DOCUMENTS

| | | |
|---|---|---|
| 0 710 571 | 5/1996 | European Pat. Off. . |
| 0 757 284 | 2/1997 | European Pat. Off. . |
| 0 803 377 A1 | 10/1997 | European Pat. Off. . |

*Primary Examiner*—Richard L. Schilling
*Attorney, Agent, or Firm*—Paul A. Leipold

[57] ABSTRACT

The invention relates to an imaging element comprising a laminated base comprising a layer of biaxially oriented film sheet adhered to the top surface of a base wherein said laminated base has a surface roughness average of between about 0.5 to 2.5 $\mu$m

37 Claims, No Drawings

IMAGING ELEMENT WITH BIAXIALLY ORIENTED FACE SIDE WITH NON GLOSSY SURFACE

FIELD OF THE INVENTION

This invention relates to the formation of laminated substrate for imaging materials. It particularly relates to improved substrates for photographic materials.

BACKGROUND OF THE INVENTION

In the formation of photographic paper it is known that surfaces of varying roughness and patterns can be created by casting a layer of polyethylene against a roughed chill roller. The photographic support is then coated on the chill roller side with a silver imaging emulsion layer. The rough surface is then transferred to the surface of the image creating a rough image surface of significant commercial value.

It has been proposed in U.S. Pat. No. 5,244,861 to utilize biaxially oriented polypropylene sheets laminated to cellulose photographic paper for use as a reflective receiver for the thermal dye transfer imaging process. In the formation of biaxially oriented sheets described in U.S. Pat. No. 5,244,861, a coextruded layer of polypropylene is cast against a water cooled roller and quenched by either immersion in a water bath or by cooling the melt by circulating chill liquid internal to the chill roll. The sheet is then oriented in the machine direction and in the transverse direction. The biaxially orientation process creates a sheet that is substantially smooth, and in the final image form yields a glossy image. There remains a need to create a rough surface to decrease the gloss of the thermal dye transfer image for consumers that desire a low gloss image.

In U.S. application Ser. No. 08/862,708 filed May 23, 1997 it has been proposed to use biaxially oriented polyolefin sheets laminated to photographic grade paper as a photographic support for silver halide imaging systems. In U.S. application Ser. No. 08/862,708 filed May 23, 1997 numerous advantages are obtained by the use of the high strength biaxially oriented polyolefin sheets. Advantages such as increased opacity, improved image tear resistance and improved image curl. While all of these photographic improvements are possible with the use of biaxially oriented polyolefin sheets, the use of biaxially oriented sheets with solid surface skins for silver halide imaging systems is restricted to glossy images. In the final image format, in which the image is glossy, significant reflection can occur when the consumer views the image with various lighting conditions and viewing angles. For some segment of the photographic market, the large amount of reflection is unacceptable. There remains a need for a non-glossy biaxially oriented silver imaging surface for consumers that desire images with a low surface reflection.

Photographic papers that are smooth and have a high level of gloss have a tendency to show fingerprints, handling marks and abrasions when compared to images printed on non glossy photographic paper. In instances where the final image will be handled, there remains a need for a biaxially oriented photographic support that will have less tendency to show fingerprints and abrasions.

Photographic papers that are smooth on the image side will tend to scratch during consumer handling. These scratches will reduce the commercial value of the image and are objectionable. There remains a need for a biaxially oriented photographic support that will be more resistant to showing scratches.

SUMMARY OF THE INVENTION

An object of the invention is to provide improved imaging materials.

A further object is to provide a base for images that will have the required face side roughness.

Another object is to provide an imaging material that does not block when stored in stacks.

A further object is to provide a base for imaging that has reduced gloss and glare when viewing the print.

A further object is to provide a base for imaging that has a reduced propensity for showing scratches.

A further object is to provide a base for imaging that has a reduced propensity for showing fingerprints.

These and other objects of the invention generally are accomplished by an imaging element comprising a laminated base comprising a layer of biaxially oriented film sheet adhered to the top surface of a base wherein said laminated base has a surface roughness average of between about 0.5 to 2.54 micrometers.

ADVANTAGEOUS EFFECT OF THE INVENTION

The invention provides an improved base for the casting of photosensitive and other imaging layers. It particularly provides an improved laminated base for color photographic materials that have the required face side roughness for print viewing with reduced glare, reduced tendency for scratching and finger printing. The laminated base creates effects that are pleasing to the viewer.

DETAILED DESCRIPTION OF THE INVENTION

There are numerous advantages of the invention over prior practices in the art. The invention provides a photographic element that has a non glossy surface. The non glossy surface has significant commercial value as there are many consumers that desire less glare when viewing images. Further, the invention provides a photographic paper that has less tendency to scratch and show marks and abrasions when compared to glossy images. Photographic papers that are smooth and have a high level of gloss can be easily scratched or marked making the image undesirable.

Another advantage of a non glossy surface is the reduction in the tendency for the imaged prints to stick together. Images in the final customer format are commonly stored as a stack, image side to backside and under a variety of humidity conditions. Glossy, smooth image surfaces have a larger contact area than rough image surfaces creating a tendency for glossy images to stick together.

A further advantage of rougher surfaces is that they create a softer image that is more appealing in fine arts and portrait markets than glossy images. These and other objects of the invention will be apparent from the detailed description below.

The terms as used herein, "top", "upper", "emulsion side", and "face" mean the side or towards the side of a imaging member bearing the imaging layers. The terms "bottom", "lower side", and "back" mean the side or towards the side of the imaging member opposite from the side bearing the imaging layers or developed image.

Any suitable biaxially oriented polyolefin sheet may be used for the sheet on the top side of the laminated base used in the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets may be formed as in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density", is calculated as follows:

Composite Sheet Density×100=% of Solid Density
Polymer Density

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thickness higher than 70 $\mu$m, little improvement in either surface smoothness or mechanical properties are seen, and so there is little justification for the further increase in cost for extra materials.

The biaxially oriented sheets of the invention preferably have a water vapor permeability that is less than $0.85\times10^{-5}$ g/mm$^2$/day. This allows faster emulsion hardening, as the laminated support of this invention greatly slows the rate of water vapor transmission from the emulsion layers during coating of the emulsions on the support The transmission rate is measured by ASTM F1249.

"Void" is used herein to mean devoid of added solid and liquid matter, although it is likely the "voids" contain gas. The void-initiating particles which remain in the finished packaging sheet core should be from 0.1 to 10 micrometers in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar–C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')–C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the crosslinked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The surface roughness of biaxially oriented film or Ra is a measure of relatively finely spaced surface irregularities such as those produced on the backside of photographic materials by the casting of polyethylene against a rough chilled roll. The surface roughness measurement is a measure of the maximum allowable roughness height expressed in micrometerss by use of the symbol Ra. For the irregular profile of the face side of imaging materials of this invention, the average peak to valley height, which is the average of the vertical distances between the elevation of the highest peak and that of the lowest valley, is used.

Biaxially oriented polymer sheets commonly used in the packaging industry as well as other industries and markets are commonly melt extruded and then oriented in the machine and transverse directions to give the sheet desired mechanical strength properties. The process of biaxially orientation of polyolefin generally creates a surface of less than 0.23 $\mu$m. A laminated photographic support using typical biaxially oriented polyolefin sheets laminated to photographic base paper will have a surface with a roughness of 0.58 $\mu$m or less. This is considered a glossy surface. A surface roughness greater than 0.58 $\mu$m would be considered a non glossy surface. A surface roughness of the photographic support is preferably substantialy zero for surface roughness when it has a spacial frequency of greater than 1200 $\mu$m. The term substantialy zero refers to the need to provide a flat surface for surface roughness with a frequency greater than 1200 $\mu$m, for example, surface roughness in the spacial frequency range at about 1200 to 3600 $\mu$m is typically less than 0.1 Ra. Surface roughness greater than zero at a spatial frequency greater than 1200 $\mu$m would yield a photographic element with a undesirable appearance known in the art as orange peel. For some consumers the presence of orange peel roughness in an image is undesirable.

Rougher surfaces on a biaxially oriented polymer sheet can be formed integrally with the sheet to create a surface roughness average of between about 0.5 to 2.5 $\mu$m. Deeper and sharper roughness profiles can be achieved to create various effects to the final imaging surface. These surfaces can either be random in nature or have an ordered pattern. A random surface pattern is preferred as a random surface pattern scatters reflected light in a random fashion which is particularly useful in many photographic markets. Random surfaces are those that do not have a defined regularity or orderliness to the roughness peaks or their spatial frequency.

Ordered patterns of surface roughness are also preferred. In general ordered patterns are those surfaces that have repeating roughness and or spatial frequencies associated with the surface. Ordered patterns of roughness reflect light in an ordered way creating a surface that is useful in many commercial applications such as the portrait market.

A surface roughness of between 0.5 $\mu$m and 2.5 $\mu$m is preferred. Surface roughness less than 0.5 $\mu$m is considered by consumers to be non glossy. Surface roughness greater than 3 $\mu$m is considered by consumers to be too rough, thereby reducing the commercial value of images with surface roughness greater than 3 $\mu$m.

Surface roughness in a biaxially oriented sheet can be made by applying a mixture of aqueous or solvent polymer binder with an inorganic pigment or filler. The preferred inorganic pigments of use in this invention are titanium dioxide, silica, talc, calcium carbonate, barium sulfate, kaolin, and diatomaceous earth. The particle size of the pigment or filler can be adjusted to control the roughness effect, as well as the ratio of pigment to binder.

Another means to achieve the desire roughness effect is to integrally form the rough surface with the biaxially oriented sheet by incorporating an inorganic pigment or filler with the polymer structure at the time of extrusion. Said pigment can be incorporated in at least one or more layers of the biaxially oriented sheet. Particle size and concentration are key factors in achieving the roughness characteristic. The preferred particle size average is about between 0.2 and 10.0 $\mu$m in a weight percentage about between 2–50%. Particle sizes less than 0.20 $\mu$m do not create surface roughness greater than 0.5 $\mu$m. Particle sizes greater than 10 $\mu$m will create unwanted voiding of the skin layer decreasing the commercial value of the image. The layer thickness ratio of the polymer skin layer to the particle size of said inorganic pigment should be less than one for optimal physical roughness.

A further method to achieve the desired surface roughness of biaxially oriented sheets is the use of incompatible block copolymers. Block copolymers of this invention are polymers containing long stretches ot two or more monomeric units linked together by chemical valences in one single chain. The block copolymers do not mix during biaxially orientation and create desired surface roughness and a lower surface gloss when compared to homopolymers. The preferred block copolymers of this invention are mixtures of polyethylene and polypropylene.

Another method to achieve the desired roughness on the top surface of a biaxially oriented sheet is to overcoat said sheet after orientation with a polymer layer that is applied to said sheet and cast against a roller surface with the desired roughness characteristics. Said polymer is above the glass tansition point at the time of casting and is quickly solidified by cooling. This could be either a random or order pattern. A typical means and material would be to melt cast a layer(s) of polyethylene on the surface of a laminated support Polyolefin and polyester materials are preferred.

A random or order pattern that provides the desired roughness characteristics can also be imparted to the biaxially oriented sheet by an embossing process. In this process the preformed biaxially oriented sheet or the laminated base with the biaxially oriented sheet attached to the support is passed through a nip consisting of a roller with the desired pattern and a backing roller. The top side or the side that is receiving the photographic emulsion is usually run against the roughen roller. High pressure is used to emboss the roughened surface characteristics into the surface of the biaxially oriented sheet surface. With the use of very high pressures, the roughened characteristics can be imparted to the entire thickness of the laminated support. The roughened characteristics can either be random or an ordered pattern.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 or more layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a typical biaxially oriented sheet of the invention is as follows:

| |
|---|
| Solid top skin layer |
| Core layer |
| Solid skin layer |

The sheet on the side of the base paper opposite to the emulsion layers may be any suitable sheet. The sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425, the disclosure of which is incorporated by reference.

The preferred biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent non-planarity in the support and would be more difficult to manufacture. At thicknesses higher than 70 $\mu$m, little improvement in either surface smoothness or mechanical properties are seen, and so there is little justification for the further increase in cost for extra materials.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefms include polypropylene, polyethylene, polymethylpentene, and mixtures thereof. Polyolefin copolymers, including copolymers of propylene and ethylene such as hexene, butene and octene, are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol hexanediol, 1,4-cyclohexanedimethanol, diethylene glycol other polyethylene glycols, and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with layers of the same polymeric material, or it can be made with layers of different polymeric composition. For compatibility, an auxiliary layer can be used to promote adhesion of multiple layers.

Addenda may be added to the biaxially oriented backside sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The biaxially oriented sheet on the backside of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma, or corona discharge treatment to improve printability or adhesion.

The structure of a typical biaxially oriented sheet that may be laminated, with the skin layer exposed, to the backside of the laminated base of imaging elements is as follows:

| |
|---|
| treated skin layer |
| solid core layer |

The support to which the microvoided composite sheets and biaxially oriented sheets are laminated for the laminated support or laminated base of the photosensitive silver halide layer in a photographic element may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312; and 5,055,371.

The preferred support is a photographic grade cellulose fiber paper. When using a cellulose fiber paper support, it is preferable to extrusion laminate the microvoided composite sheets to both sides of the base paper using a polyolefin resin. Extrusion laminating is carried out by bringing together the biaxially oriented sheets of the invention and the base paper with application of an adhesive between them followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheet(s) in order to minimize curl in the resulting laminated support. For high humidity applications (>50% RH) and low humidity applications (<20% RH), it is desirable to laminate both a front side and backside film to keep curl to a minimum.

The surface roughness of this invention can also be accomplished by laminating a biaxially oriented sheet to a paper base that has the desired roughness. The roughness of the paper base can be accomplished by any method known in the art such as a heated impression nip or a press felt combined with a roller nip in which the rough surface is part of the press nip. The preferred roughness of the base paper is from 35 $\mu$m to 150 $\mu$m. This preferred range is larger than roughness range for the imaging support because of the loss of roughness that occurs in melt extrusion lamination.

In one preferred embodiment, in order to produce photographic elements with a desirable photographic look and feel, it is preferable to use relatively thick paper supports (e.g., at least 120 mm thick, preferably from 120 to 250 mm thick) and relatively thin microvoided composite sheets (e.g., less than 50 mm thick, preferably from 20 to 50 mm thick, more preferably from 30 to 50 mm thick).

As used herein the phrase "imaging element" is a material that may be used as a laminated support for the transfer of images to the support by techniques such as ink jet printing or thermal dye transfer, as well as a support for silver halide images. As used herein, the phrase "photographic element" is a material that utilizes photosensitive silver halide in the formation of images. In the case of thermal dye transfer or ink jet, the image layer that is coated on the imaging element may be any material that is known in the art such as gelatin, pigmented latex, polyvinyl alcohol, polycarbonate, polyvinyl pyrrolidone, starch, and methacrylate that will allow the ink jet or thermal image to adhere.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process,* Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dinethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The photographic elements of this invention may use emulsions doped with Group VIII metals such as iridium, rhodium, osmium, and iron as described in *Research Disclosure,* September 1996, Item 38957, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

In the following table, reference will be made to (1) *Research Disclosure,* December 1978, Item 17643, (2) *Research Disclosure,* December 1989, Item 308119, and (3) *Research Disclosure,* September 1996, Item 38957, all published by Kenneth Mason Publications, Ltd., Dudley Annex, 12a North Street, Emsworth, Hampshire PO10 7DQ, ENGLAND. The table and the references cited in the table are to be read as describing particular components suitable for use in the elements of the invention. The able and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation induding |
| 3 | I, II, III, IX A & B | hardeners, coating aids, addenda, etc. |
| 1 | III, IV | Chemical sensitization and |
| 2 | III, IV | spectral sensitization/ |
| 3 | IV, V | desensitization |
| 1 | V | UV dyes, optical |
| 2 | V | brighteners, luminescent |
| 3 | VI | dyes |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The laminated substrate of the invention may have copy restriction features incorporated such as disclosed in U.S. patent application Ser. No. 08/598,785 filed Feb. 8, 1996 and application Ser. No. 08/598,778 filed on the same day. These applications disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the backside to enable users or machines to read and identify the media. The media may take the form of sheets that are capable of bearing an image. Typical of such materials are photographic paper and film materials composed of polyethylene resin coated paper, polyester, (poly)ethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light-sensitive media.

In a preferred embodiment the creation of the microdot pattern as a latent image is possible through appropriate temporal, spatial, and spectral exposure of the photosensitive materials to visible or non-visible wavelengths of electromagnetic radiation. The latent image microdot pattern can be rendered detectable by employing standard photographic chemical processing. The microdots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in *Research Disclosure* 37038 of February 1995.

Commercial Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylarnide, and 5.0% $TiO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

The following examples illustrate the practice of this invention. They are not intended to be exhaustive of all possible variations of the invention. Parts and percentages are by weight unless otherwise indicated.

EXAMPLES

Example 1

The following laminated photographic bases in table I were prepared by extrusion laminating several different biaxially oriented sheets to the emulsion side of the photographic grade cellulose paper base. The same biaxially oriented sheets were laminated to the backside of the photographic grade cellulose paper base in each sample.

Bottom sheet: (backside)

BICOR 70 MLT (Mobil Chemical Co.), a one-side matte finish, one-side treated biaxially oriented polypropylene sheet (18 mm thick) (d=0.9 g/cc) consisting of a solid oriented polypropylene core and a skin layer of a block copolymer of polyethylene and polypropylene. The matte finish side is exposed after lamination The following sheets were then laminated to the face side (emulsion side) of the photographic grade cellulose paper base creating photographic bases A–G. In each of A to F the lamination leaves the skin layer exposed of the top of the laminated base.

Photographic paper base A:

BICOR 70 MLT (Mobil Chemical Co.), a one-side matte finish, one-side treated biaxially oriented polypropylene sheet (18 mm thick) (d=0.9 g/cc) consisting of a solid oriented polypropylene core and a skin layer of a block copolymer of polyethylene and polypropylene.

Photographic paper base B:

A one-side matte finish, one-side treated biaxially oriented polypropylene sheet (18 mm thick) (d=0.9 g/cc) consisting of a solid oriented polypropylene core and a skin layer of polypropylene and 25% $CaCO_3$.

Photographic paper base C:

A one-side matte finish, one-side treated biaxially oriented polypropylene sheet (18 mm thick) (d=0.9 g/cc) consisting of a solid oriented polypropylene core and a skin layer of polypropylene and 15% $CaCO_3$.

Photographic paper base D:

A one-side matte finish, one-side treated biaxially oriented polypropylene sheet (18 mm thick) (d=0.9 g/cc) consisting of a solid oriented polypropylene core and a skin layer of HDPE and 24% $CaCO_3$.

Photographic paper base E:

A one-side matte finish, one-side treated biaxially oriented polypropylene sheet (18 mm thick) (d=0.9 g/cc) consisting of a solid oriented polypropylene core and a skin layer of HDPE and 16% $CaCO_3$.

Photographic paper base F:

A one-side matte finish, one-side treated biaxially oriented polypropylene sheet (18 mm thick) (d=0.9 g/cc) consisting of a solid oriented LDPE core and a skin layer of LDPE and 10% silica.

Photographic paper base G:

BICOR LBW (Mobil Chemical Co.), a biaxially oriented, polypropylene sheet (18 mm thick) (d=0.9 g/cc) consisting of a single solid polypropylene layer.

The photographic bases in Table I were prepared by melt extrusion laminating using 1924P Low Density Polyethylene (Eastman Chemical Co.) (a extrusion grade low density polyethylene with a density of 0.923 g/cm$^3$ and a melt index of 4.2) as the bonding layer. Both the top sheet and bottom sheets were laminated to a photographic grade cellulose paper. Photographic bases A–G were emulsion coated using a standard color silver halide system.

The roughness of the front side of each support variation was measured by TAYLOR-HOBSON Surtronic 3 with 2 $\mu$m diameter ball tip. The output Ra or "roughness average" from the TAYLOR-HOBSON is in units of microinches and has a built in cut off filter to reject all sizes above 0.25 mm. The roughness averages of 10 data points for each base variation is listed in Table I.

TABLE I

| Base Variation | Roughness (micrometers) |
|---|---|
| A | 0.55 |
| B | 0.64 |
| C | 0.55 |
| D | 0.7 |
| E | 0.64 |
| F | 0.58 |
| G | 0.17 |

The data in table I show the significant improvement in image roughness of bases A–F compared to the roughness of a typical biaxially oriented polyolefin sheet (variation G). The improvement in image roughness is significant because bases A–F have sufficient roughness to create a non glossy surface. The roughness improvement to the image side is also large enough to allow for reduction in the tendency for the image to scratch or show fingerprints after significant handling of the image in the final format Photographic bases A–F were also improved for photographic print blocking, as the increase roughness reduced the contact area when prints were stacked emulsion to backside.

Example 2

A plain BICOR one side treated biaxially oriented polypropylene sheet (0.75 mils thick) (d=0.95 g/cc) was coated with a dispersion of an aqueous of polyvinyl alcohol and $TiO_2$ with a particle size of 0.40 $\mu$m. The pigment to binder ratio was 1 to 1 on a dry weight basis and the coating coverage was 20 mg/m$^2$. The above-coated biaxially oriented sheet was then extrusion laminated to a photographic cellulose paper base with a commercial grade of low density polyethylene (d=0.923 and a melt index of 4.0) as the bonding layer. Coating format 1 was utilized to prepare photographic print materials utilizing the above laminated supports.

| | Coating Format I | Laydown mg/m$^2$ |
|---|---|---|
| Layer 1 | Blue Sensitive Layer | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |

-continued

| | Coating Format I | Laydown mg/m$^2$ |
|---|---|---|
| Layer 3 | Green Sensitive Layer | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Oelatin | 440 |
| | UV-1 | 20 |
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |
| | $SiO_2$ | 200 |
| | Surfactant | 2 |

Y-1

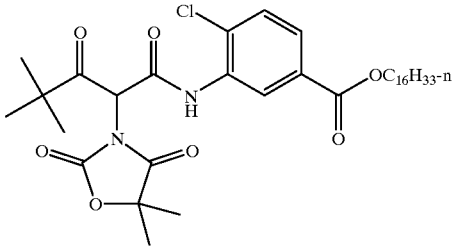

ST−1=N-tert-butylacrylamide/n-butyl acrylate copolymer (50:50)

S−1=dibutyl phthalate

SC-1

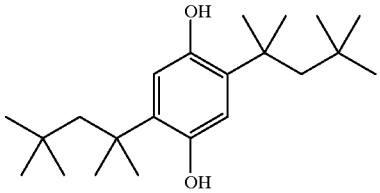

-continued

M-1

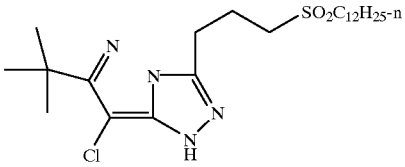

S−2=diundecyl phthalate

ST-2

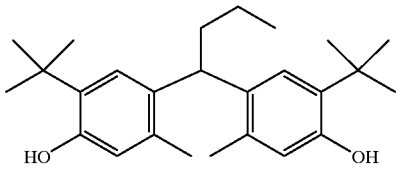

ST-3

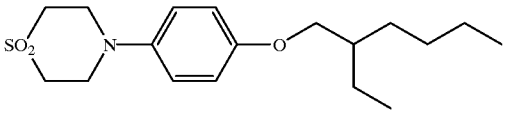

ST-4

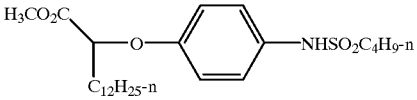

UV-1

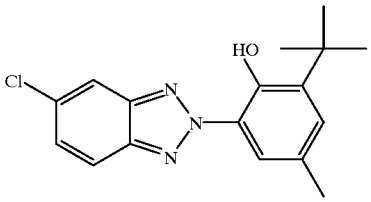

UV-2

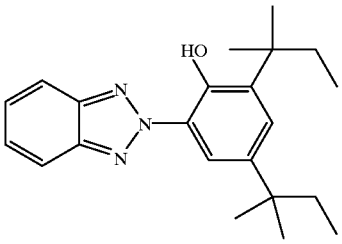

S−3=1,4-Cyclohexyldimethylene bis(2-ethylhexanoate)

C-1

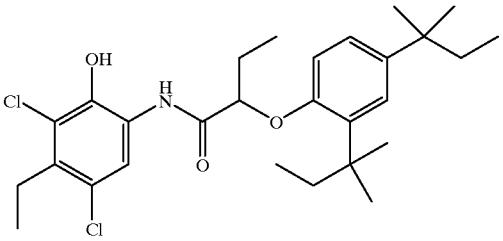

S–4=2-(2-Butoxyethoxy)ethyl acetate

Dye 1

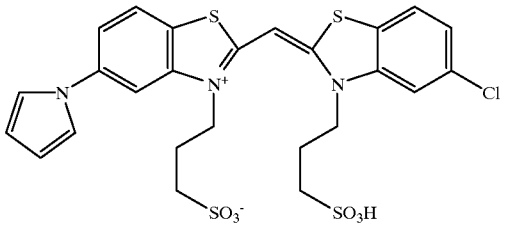

The roughness of the front side of the above photographic support was measured by TAYLOR-HOBSON Surtronic 3 with 2 μm diameter ball tip. The output Ra or "roughness average" from the TAYLOR-HOBSON is in units of microinches and has a built-in cutoff filter to reject all sizes above 0.25 mm. The surface roughness of the photographic support in this example was 0.85 μm. Images that were subsequently made using is support were classified as non glossy when viewed by consumers of photographic paper. These images also showed a reduction in fingerprints after images were handled by test subjects when compared to images created with standard photographic papers.

The invention has been described in detail with particular reference to certain preferred embodiments thereof, but it will be understood that variations and modifications can be effected within the spirit and scope of the invention.

What is claimed is:

1. An imaging element comprising silver halide photosensitive materials and a laminated base comprising a layer of biaxially oriented polymer film sheet adhered to the top surface of a base wherein said laminated base has a top surface layer roughness average of between about 0.5 to 2.5 μm.

2. The imaging element of claim 1 wherein said surface roughness is in a random pattern.

3. The imaging element of claim 1 wherein said surface roughness is in an ordered pattern.

4. The imaging element of claim 1 wherein the layer on the top surface of the biaxially oriented sheet comprises a material selected from the group consisting of titanium dioxide, silica, talc, calcium carbonate, barium sulfate, kaolin, and mixtures thereof.

5. The imaging element of claim 1 wherein the top surface layer further comprises inorganic particulate materials having a size between 0.2 and 10.0 μm.

6. The imaging element of claim 1 wherein the layer on the top surface of the biaxially oriented sheet comprises block copolymers of polypropylene and polyethylene.

7. The element of claim 1 wherein said base comprises cellulose fiber paper and said surface roughness is imparted by the surface roughness of the paper base.

8. The imaging element of claim 1 further comprising a biaxially oriented polymer film sheet adhered to the lower side of said base.

9. The imaging element of claim 1 wherein said element has a surface roughness of substantialy zero for a spatial frequency greater than 1200 μm.

10. The imaging element of claim 1 wherein said base comprises paper.

11. A method of forming an imaging element comprising providing a base material and laminating a biaxially oriented polymer sheet to said base material wherein the top surface of said sheet has a surface roughness average between 0.5 and 2.5 μm and applying image forming materials to said top surface layer and further comprising laminating a biaxially oriented polymer sheet to the bottom of said base material.

12. The method of claim 11 wherein said laminating is carried out with a melt extruded polyolefin adhesive.

13. The method of claim 11 wherein said top surface has an exposed surface that comprises a layer of particles in a nonoriented polymer matrix that has been coated onto said biaxially oriented sheet.

14. The method of claim 11 wherein said top surface layer has an exposed surface that comprises a layer of particles in the surface layer of the biaxially oriented film.

15. The method of claim 13 wherein said particles comprise inorganic particles.

16. The method of claim 14 wherein said particles comprise inorganic particles.

17. The method of claim 11 wherein said top surface has an exposed surface that comprises an embossed surface.

18. The method of claim 11 wherein said surface is melt cast against a roller surface by applying a polymer layer to the biaxially oriented polymer sheet.

19. The method of claim 18 wherein said polymer comprises polyolefin or polyester.

20. The imaging element of claim 1 wherein said base comprises cellulose fiber paper.

21. The method of claim 11 wherein said base material comprises cellulose fiber paper.

22. The method of claim 11 wherein said image forming materials comprise at least one layer of photosensitive silver halide grains and dye forming coupler.

23. The imaging element of claim 1 wherein said biaxially oriented polymer film sheet on the top of said base comprises polypropylene.

24. The imaging element of claim 26 wherein said laminated base further comprises a biaxially oriented film on the bottom of said base said biaxially oriented film sheet on the bottom of said base comprises polypropylene.

25. An imaging element comprising a laminated base comprising a layer of biaxially oriented polymer film sheet adhered to the top surface of a base wherein said laminated base has a top surface layer roughness average of between about 0.5 to 2.5 μm and a biaxially oriented polymer film sheet adhered to the lower side of said base.

26. The imaging element of claim 25 wherein said surface roughness is in a random pattern.

27. The imaging element of claim 25 wherein said surface roughness is in an ordered pattern.

28. The imaging element of claim 25 wherein the layer on the top surface of the biaxially oriented sheet comprises a material selected from the group consisting of titanium dioxide, silica, talc, calcium carbonate, barium sulfate, kaolin, and mixtures thereof.

29. The imaging element of claim 25 wherein the top surface layer further comprises inorganic particulate materials having a size between 0.2 and 10.0 μm.

30. The imaging element of claim 25 wherein the layer on the top surface of the biaxially oriented sheet comprises block copolymers of polypropylene and polyethylene.

31. The imaging element of claim 25 further comprising at least one layer of silver halide photosensitive materials and dye forming coupler.

32. The imaging element of claim 25 further comprising at least one layer comprising thermal or ink jet image receiving materials.

33. The imaging element of claim 25 wherein said element has a surface roughness of substantially zero for a spatial frequency greater than 1200 μm.

34. The imaging element of claim 25 wherein said base comprises paper.

35. The element of claim 25 wherein said base comprises cellulose fiber paper and said surface roughness is imparted by the surface roughness of the paper base.

36. The imaging element of claim 25 wherein said biaxially oriented polymer film sheet on the top of said base comprises polypropylene.

37. The imaging element of claim 36 wherein said biaxially oriented film sheet on the bottom of said base comprises polypropylene.

* * * * *